US005906191A

United States Patent [19]

Wonisch et al.

[11] Patent Number: 5,906,191

[45] Date of Patent: May 25, 1999

[54] COMPRESSED GAS-OPERATED SHOOTING WEAPON

[75] Inventors: Franz Wonisch; Dietmar Emde, both of Arnsberg, Germany

[73] Assignee: Umarex Sportwaffen GmbH & Co. KG, Arnsberg, Germany

[21] Appl. No.: 09/068,709

[22] PCT Filed: Sep. 21, 1996

[86] PCT No.: PCT/EP96/04132

§ 371 Date: May 14, 1998

§ 102(e) Date: May 14, 1998

[87] PCT Pub. No.: WO97/18431

PCT Pub. Date: May 22, 1997

[30] Foreign Application Priority Data

Nov. 14, 1995 [DE] Germany ..... 195 42 332

[51] Int. Cl.[6] ..... F41C 3/10

[52] U.S. Cl. ..... 124/31; 124/40; 124/48; 124/74

[58] Field of Search ..... 124/31, 40, 48, 124/73, 74

[56] References Cited

U.S. PATENT DOCUMENTS

| | | | |
|---|---|---|---|
| 5,285,766 | 2/1994 | Milliman | 124/72 |
| 5,400,536 | 3/1995 | Milliman | 42/65 |
| 5,711,286 | 1/1998 | Petrosyan et al. | 124/73 |

*Primary Examiner*—J. Woodrow Eldred
*Attorney, Agent, or Firm*—Scully, Scott, Murphy & Presser

[57] ABSTRACT

The invention discloses a compressed gas-operated firearm (1), especially a pistol, which at the utilization of a drum (18) for multi-shot projectile receipt distinguishes itself through a linearly displaceable weapon barrel (3) to achieve a loading position, or, respectively, firing position, and through a trigger (4) which is automatically secured against actuation in the loading position. Furthermore, a new type of valve system (25) is proposed for the impulse-like emission of the compressed gas upon the discharge of a shot.

6 Claims, 5 Drawing Sheets

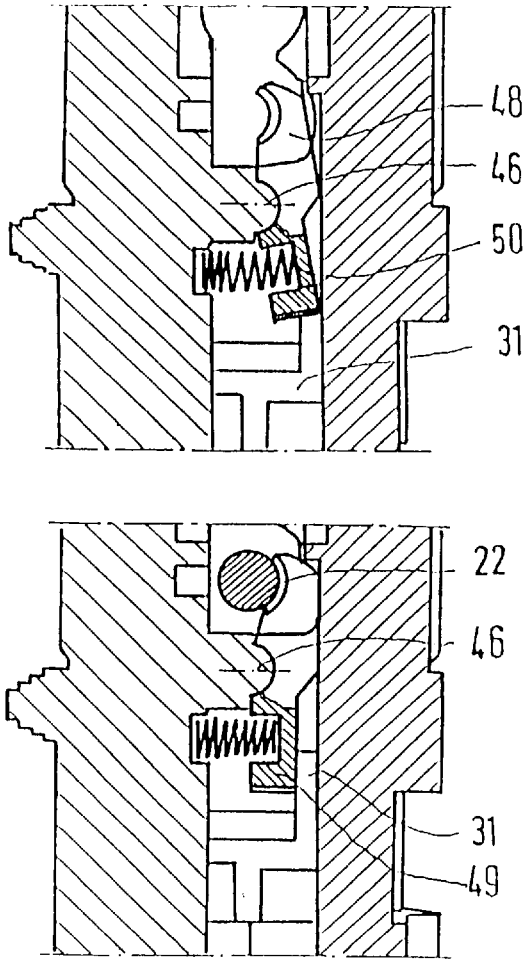
FIG. 5
FIG. 4
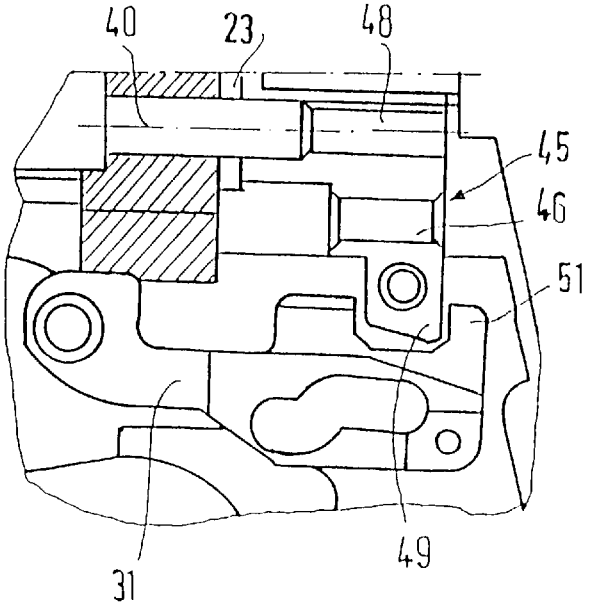

COMPRESSED GAS-OPERATED SHOOTING WEAPON

BACKGROUND OF THE INVENTION

1. Field of the Invention

The present invention relates to a compressed gas-operated firearm, particularly a pistol.

2. Discussion of the Prior Art

A firearm of that type is known from the disclosure of U.S. Pat. No. 5,160,795. This known firearm possesses a frame on which there is arranged the weapon barrel. Furthermore, there is provided a drum or ammunition cylinder for the receipt of projectiles or, respectively, firing bodies, which is installed on the barrel arrangement so as to be rotatable about its own axis. The axis of rotation of the drum extends in parallel with the longitudinal axis of the weapon barrel. The rotational movement and the adjustment of the drum is undertaken through the intermediary of a lever system which stands in operative connection with the trigger system of the firearm. The weapon barrel, together with the drum and the lever system is pivotable upwardly through a forward axis out of the frame for the assumption of the loading position. In this outwardly pivoted position, the drum can be reloaded with new projectiles.

The pivoting procedure of the barrel arrangement out of the frame is not without problems, inasmuch as the arrangements of the lever system and the drum which are outwardly swung together therewith, on the one hand, must be maintained in a precisely fitted position and, on the other hand, must be constructed in such a manner that the outward pivoting of the system components from the operative position in which they are linearly oriented in the firing position, must be possible without damaging the components and without adversely influencing their functioning. As a result, such a construction becomes technically complex. Moreover, there must be worried the occurrence of losses in gas pressure, which react negatively on the firing power of the firearm.

From the same U.S. Patent Publication No. 5,160,795 and also U.S. Pat. No. 5,400,536 there is known a valve system for a firearm of that type, which is inserted into the frame behind the barrel arrangement. This valve system possesses a valve member which is sealed at its end surfaces, and which receives a longitudinally movably guided valve shaft. The chamber about the valve shaft stands in communication with a compressed gas cartridge. The valve shaft possesses a rearward protrusion which is contacted by the hammer of the firearm. The forward end surface of the valve shaft acts on a spring-supported protrusion which by means of a conical contact surface contacts the bore opening of the drum. The valve shaft stands under the action of a compression spring and is moved forwardly impulse like through the hammer of the firearm upon actuation of the trigger from its sealing contact, in view of which there are opened passageways for the gas or air pressure. This entire valve arrangement is again technically complex due to its large number of interfitted components, which is required by the pivoting arrangement of the weapon barrel with the inserted drum.

Through the disclosure of German DE 29 38 600 C2, there has been disclosed a firing pin safety for a hand-held firearm or handgun. This handgun is constructed as a pistol and possesses a barrel and apparently linearly slidable carriage. On the weapon barrel there is pivotably supported a trigger in opposition to the force of a spring, which concurrently actuates a latching arrangement which engages into the forward traveling path of the firing pin.

Commencing from the above-mentioned state-of-the-art, it is an object of the present invention to provide a compressed gas-operated firearm of the above mentioned type, which by means of relatively few and technically simple assembly and system components affords a secure and simple handling and functioning of the firearm.

SUMMARY OF THE INVENTION

In accordance with the object of the invention, the significant features can be ascertained in that the compressed gas-operated firearm which is known from the state of the technology possesses a linearly displaceable barrel arrangement so as to be able to come from the firing position into the loading position and conversely. Hereby, by means of a further essential feature there is ensured that the trigger of the firearm is automatically latched in the loading position. As is detailed hereinbelow, it has been ascertained in a surprising manner that the linear displaceability of the barrel arrangement, and the drum which is resultingly releasable from the barrel, lead to simple system components and concurrently to a higher firing power at optimum weapon safety.

The displacement of the weapon barrel into the loading position of the firearm is effected through spring force, as soon as the latching lever on the breech mechanism of the firearm is manually pivoted into the unlatched position. Consequently, there is concurrently drawn the axle out of the drum, which is then simply removable for reloading from the weapon frame or respectively, breech mechanism. The pulling out of the drum axle now causes that the first arm of the double-armed lever swings radially into the theoretical center of the axis. As a result thereof, the second arm is automatically moved into axial path of movement of the slider, whereby the entire trigger system is blocked.

Inasmuch as the barrel arrangement is linearly displaceable, the sealing of the valve system is also relatively simple with regard to the drum. The hollow cylindrical valve stem lies with its forward end surface in the firing position due to the impulse at the discharge of a shot directly sealingly against the facing bore opening of the drum. This is effected in a sensible manner through the utilization of the released compressed gas. Particular constructive prerequisites for achieving a sealing are not necessary at the end surface of the stem.

BRIEF DESCRIPTION OF THE DRAWINGS

In the drawing, there is illustrated an example of the invention; wherein:

FIG. 4 illustrates the secured position of the trigger at an assumed loading position of the firearm, shown in cross-section;

FIG. 5 illustrates the firearm in a sectional view taken along line V—V in FIG. 4;

DETAILED DESCRIPTION OF A PREFERRED EMBODIMENT

Figure 1:
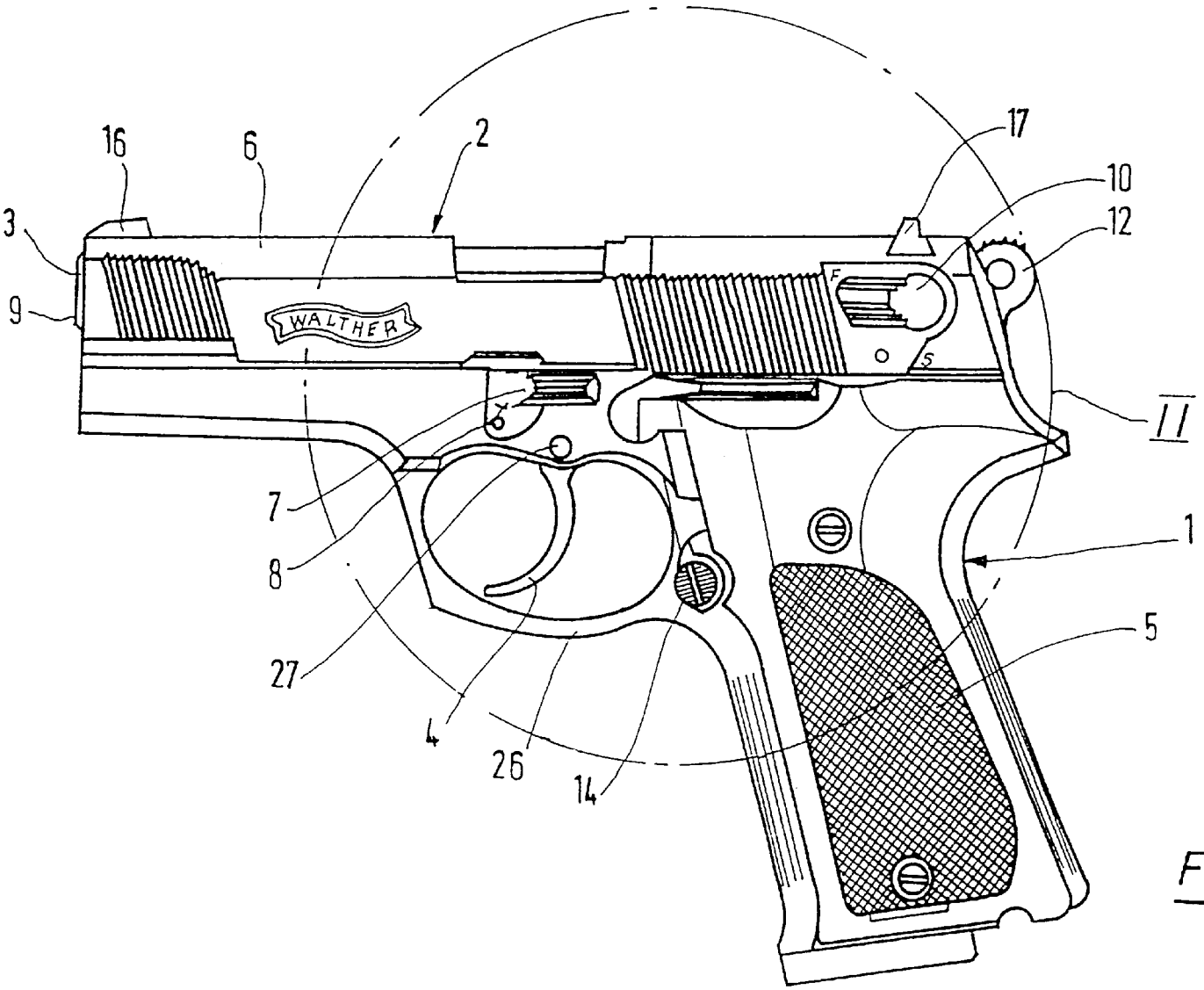
FIG. 1 shows the compressed gas-operated firearm in a side view.

The compressed gas-operated pistol 1 consists essentially of the breech block 2 (also referred to as a frame), the weapon barrel 3 arranged in the breech block, the trigger system 4 and the grip member or hand grip 5. The forward part 6 of the breech block 2 which receives the weapon barrel 3 is linearly axially displaceable from a loading position into a firing position and conversely. In the view represented in FIG. 1, the firearm 1 is in the closed position, which corresponds to the firing position. The breech block lever 7 is located in the latched position. A downward pivoting of the breech block lever 7 about the axis 8 leads to an unlatching, and thereby to the loading position of the firearm 1, in which the weapon barrel 3 is slid outwardly with the support of a spring force forwardly over the mouth of the barrel 9, as illustrated in FIG. 1.

Figure 6:
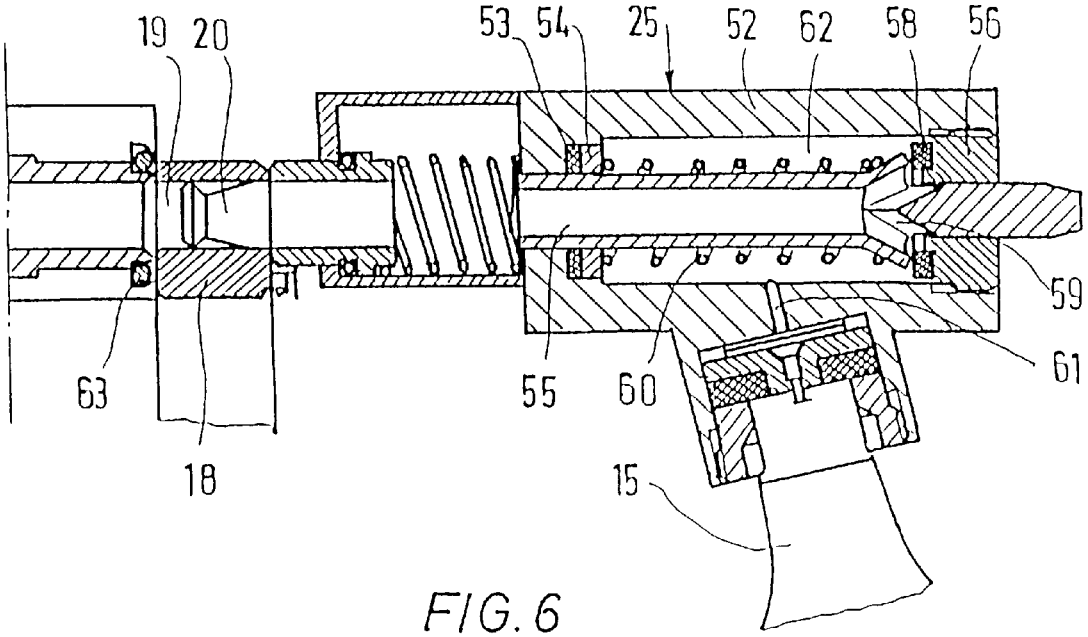
FIG. 6 illustrates the valve system of the firearm, shown in cross-section.

The securing of the firearm 1 is effected through a safety lever 10, which in the illustrated position brings a firing pin or strikes 11 into the line of action between the hammer or cock 12 and the stem 13 (in FIG. 6: bolt 57) or, respectively, the valve stem 55 towards the valve system 25, which corresponds to the firing position "F". A manual swinging about of the safety lever 10 downwardly into the position "S" rotates the firing pin or striker 11 from the upwardly described line of action into the secured position.

By means of a handle shell knob 14, the gripping shell of the grip member 5 can be opened, and which there is located a compressed gas cartridge or a capsule 15 with, for example, $CO_2$ gas. In this instance, there can also be utilized other suitable gases and air under a corresponding pressure.

In a usual manner, the firearm 1 possess a sight 16 on the forward weapon barrel part and a sighting viewer 17 on the rear frame part which is in alignment with the sight 16.

Figure 2:
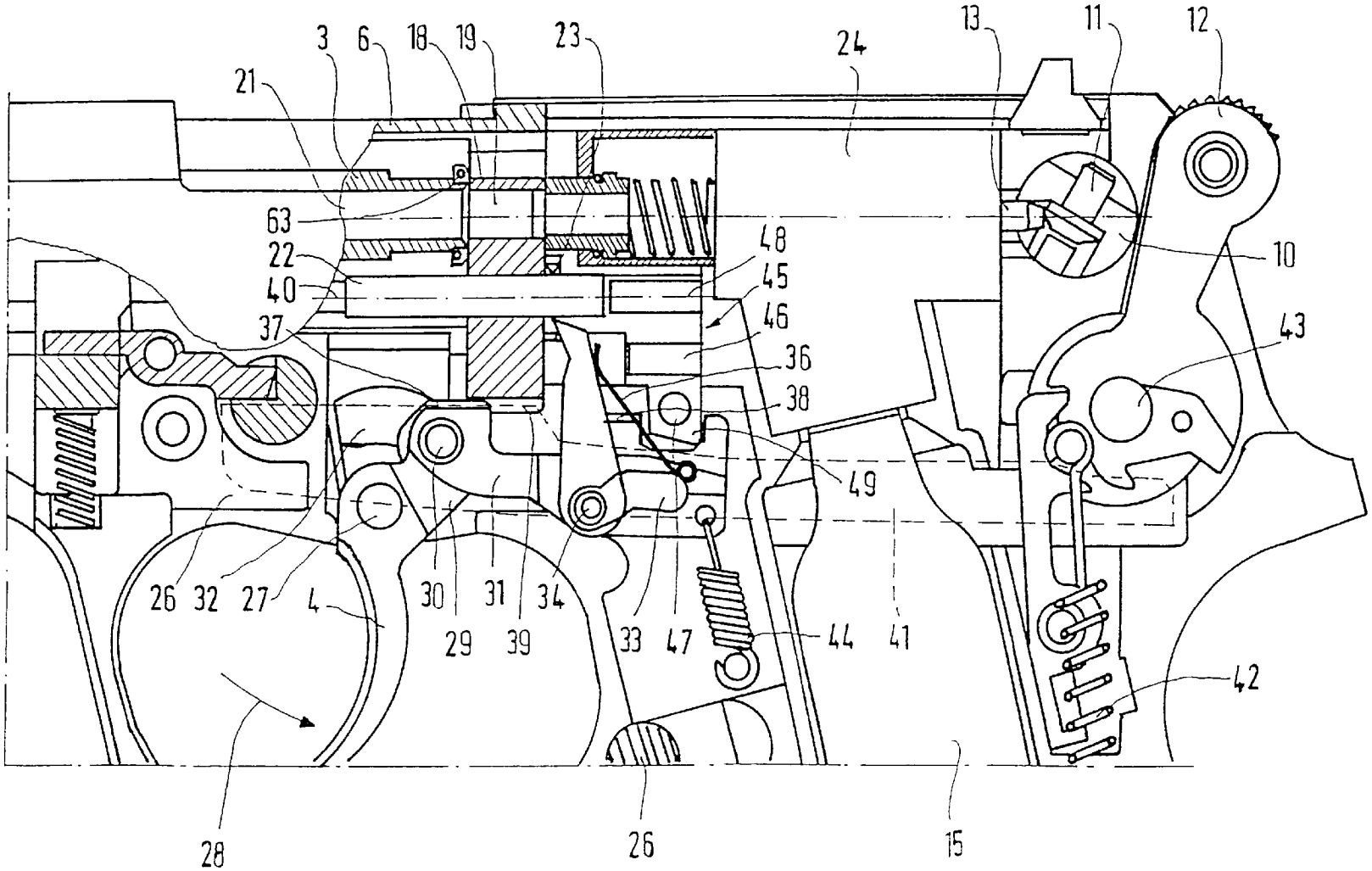
FIG. 2 shows the firearm in the secured and unstressed condition in accordance with the detail II from FIG. 1, shown in a cross-sectional view.

FIG. 2 now illustrates the unstressed and secured firearm 1 shown in cross-section. In order to disclose all of the functions and system in one representation, in the sectional representation, the essential components are illustrated superimposed on each other, and are recognizable and separated from each other only through the different kinds of drawing lines. To that extent, this sectional representation is a simplified, schematic illustration for an improved understanding of the interrelationships. In particular, the control arm 35 is clearly ascertainably illustrated and emphasized, without consideration being given to its actual position, which is partly covered by other constructional components.

In the forward breech block part 6, the weapon barrel 3 can be ascertained with inserted O-ring 63, which at its end surface borders against the drum 18. Thereby, the bore 19 of the drum 18 is oriented exactly coaxially relative to the barrel bore 21 for the receipt of projectiles or firing bodies 20. The drum 18 is rotatably arranged about an axle 22 which is inserted in the inner part. The axle bolt 22, upon displacement of the weapon barrel 3, is drawn out from the central bearing bore of the drum 18. At the rearward end surface of the drum 18 there are arranged drive elements 23, for example, a crown of gear teeth or the like. Behind the drum 18 there is located the space 24 for the insertion of a valve system 25, which is explained further hereinbelow in conjunction with FIG. 6.

The trigger 4 is pivotable about the axis 27 in the direction of arrow 28 within the trigger housing 26. The trigger 4 has a free, short arm 29, which is operatively connected by means of the linkage 30 with a slider 31 which is movable along essentially a linear path. The along of the slider 31 is hereby carried out along the path of motion 32 of the short arm 29 of the trigger 4. Introduced into the slider 31 is a curved track 33 into which a bolt 34 is slidingly inserted, which articulatedly receives a control arm 35. This control arm 35 at its free end stands under the pressure of a spring 36, and engages into the drive elements 23 of the drum 18 so as to produce a stepwise rotational movement of the drum 18. For this purpose, tip of the free end of the control arm on 35 is correspondingly configured.

The slider 31 possesses an adjusting edge 37 or 38, above, respectively, the linkage 34 and above the curved track 33 and both of which edges are arranged at a spacing from each other, which affords that always one adjusting edge 37 or, respectively 38, engages in the end positions of the slider 31 into corresponding adjusting recesses 39 arranged at the circumference of the drum 18. The adjusting recesses 39 are presently located between the drum bores 19, and in cooperation with the adjusting edges 37 or, respectively 38 of the slider 31, cause that after the effected rotation of the drum 18 through the control arm 35, there is assumed an exact coaxial position between the drum bore 19 and the weapon barrel bore 21 in the firing position.

Through the actuation of the trigger 4 in the direction of arrow 28, the slider 31 is moved forwardly, as a result of which the bolt 34 slides in the curved track 33, and guides the control arm 35 upwardly. Since the tip of the control arm 34 is located in a corresponding radial distance from the longitudinal axis 40 of the drum axle 22, the upward movement of the control arm 35 produces a step-wise rotational movement of the drum 18 on the axle bolt 22.

Moreover, a trigger rod 41 is operatively connected with the trigger 4, and which in turn stands with the hammer 12 in a ratchet connection. The hammer 12, in turn, stands under the force of a spring 42, which imparts an acceleration to the hammer 12 which is pivotable about axis 43 in the direction towards the firing pin 11. A further spring 44 and an elbow spring extending about axis 27 act in opposition to the movement of the trigger 4.

The firing pin 11 is swung out of the line of action of the hammer 12 by means of the safety lever 10 and thereby finds itself in the safety position "S". Concurrently, the hammer 12 together with the trigger rod 41 is in an unstressed condition. The springs 42 and 44 and the elbow spring extending about axis 27 are located in an idle position.

A double-armed lever 45 is pivotable about an axial bolt 46 which is stationarily arranged in the trigger housing 26 of the firearm 1 up to specified end positions under the force of a spring 50. A first arm 48 lies under spring force radially against the drum axle 22, as is illustrated in FIG. 5. In this position, the second arm 49 is located outside of the path of movement of the slider 31. The trigger system is, as a result, freely actuatable.

Figure 3:
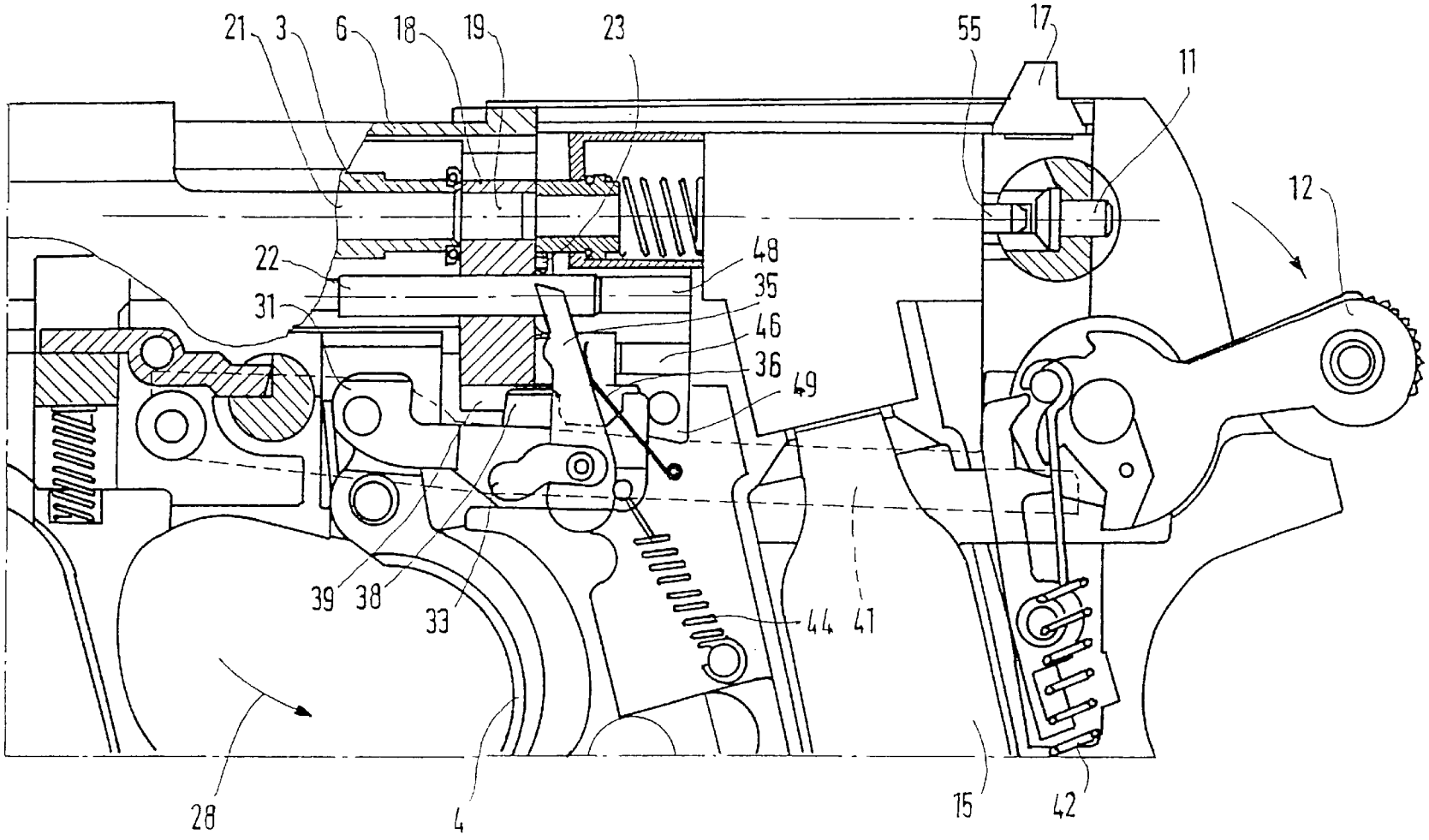
FIG. 3 illustrates the firearm in the firing position in accordance with the detail II from FIG. 1.

FIG. 3 illustrates the compressed gas-operated firearm 1 in the firing position "F". The trigger 4 has been moved in accordance with the direction of arrow 28. As a result thereof, the slider 31 was forwardly moved. The control arm 35 was upwardly guided in the curved track 33 and has rotated the drum 18 further by one step, as a result of which a new drum bore 19 (for example, with an inserted projectile) has been brought into aligned position with the weapon barrel bore 21. This position is now precisely adjusted through the engagement of the adjusting edge 38 into the adjusting recesses 39 of the drum 18. The springs 42 and 44 and the elbow spring extending about axis 27 are tensioned. The hammer 12 finds itself in the outwardly pivoted striking position. The striker or firing pin 11 lies within the line of action between hammer 12 and the valve stem 55. The trigger rod 41 is taken out of the ratchet connection, so there can be effected the discharge of a shot.

FIGS. 4 and 5 clarify the automatic latching of the trigger 4, when the firearm 11 assumes the loading position. In this loading position, the barrel 3 is slid forwardly by means of a spring force after the release of the latching engagement by the breech block lever 7, so that the drum 18, for purpose of reloading with projectiles 20, can be withdrawn from the trigger housing 26, inasmuch as through the movement of the barrel 3 forwardly, the axle bolt 22 of the drum 18 which is connected therewith is similarly pushed forwardly. The first arm 48 of the double-armed lever 45, due to the effective force of the spring 50 which, on the one side supports itself on the second arm 49 and on the other side fixedly in the trigger housing 26, swings radially into the longitudinal axis 40 of the drum 18. This is only then possible when the axle bolt 22 is moved out of the drum 18 and radially lies against the first arm 48 in the firing position. The second arm 49 is swung inwardly about the bolt 46 into the path of movement of the slider 31. As a result, there is blocked any movement of the slider 31, which by means of a rearward nose 51 stands against the arm 49. The blocking of the slider 31 acts on the trigger 4 due to the interconnection of the elements whereby in this loading position of the firearm 1 the trigger cannot be actuated.

The acceleration of the projectile 20 is effected upon the discharge of a shot in the firing position through a high impulse, which acts impact or sudden-like against the projectile 20. A $CO_2$ capsule 50 is connected in a known manner to a valve system 25. The valve system 25 consists of a valve housing 52, through the opening in the bottom of which there is conducted a hollow-cylindrical valve stem 55, which is sealed by means of a disk 53 with an O-ring 54. The forward end surface of the valve stem 55 is aligned with the drum bore 19 which is arranged in the firing position. An absolutely tightly sealed contact of this end surface is not necessary outside of the discharge of a shot.

At its head end, the opening of the valve housing 52 is closed by a threaded nut 56 which possesses a central bore through which a bolt 55 is conducted so as to be longitudinally movable. The inside of the threaded nut 56 receives a ring seal 58. The valve stem 55 possesses a conical widening 59 at the end thereof facing towards the threaded nut 56, and lies sealingly with the end of the outer edge of the widening 59 against the ring seal 58. A spring 60 which encompasses the valve stem 55 supports itself, at one side, at the bottom of the valve housing 52, and on the other side on the conical widening 59 of the valve stem 55; whereby there is attained the sealing contact of the valve stem 55 on the ring seal 58. From the $CO_2$ capsule 15 a passageway 61 leads into the compressed gas chamber 62 of the valve housing 52, so that in this chamber 62 there reigns a constant gas pressure from the $CO_2$ capsule 15.

Upon the discharge of a shot, the hammer 12 strikes in a described manner against the firing pin 11. From the latter, the striking effect is transmitted directly to the valve stem 55. The valve stem 55 releases itself for a short period of time from the sealed contact against the ring seal 58, whereby the gas flows sudden-like into the interior space of the valve stem 55, and impulse-like acts on the projectile 20. In the instance of the effective gas impulse, the forward end surface of the valve stem 55 lies sealingly against the drum 18 at an alignment with the drum bore 19. Due to the valve system this sealing contact is caused by the effective gas in connection with the sudden impulse. This valve system 25 allows for a secure single shot and also the discharge of a series of shots without any essentially adverse influence over the firing power.

What is claimed is:

1. Compressed gas-operated firearm, including a weapon frame or breech block and a weapon barrel arranged thereon, further including a drum having bores arranged in an annular ring for the receipt of projectile bodies, which is rotatably arranged about an axis in parallel with the longitudinal axis of the barrel and for the rotation thereof and precise alignment of a bore with the bore of the barrel is actuated by a lever system which is in operative connection with the trigger of the firearm, characterized in that the weapon barrel (3) is arranged linearly longitudinally displacable in the breech block (2) between a firing position and a loading position in a known manner, the trigger (4) which is pivotable about an axis (27) is articulatedly connected with a slider (31) which has a curved track (33) in which a control arm (35) is slidingly inserted, which at the free end thereof stands under a spring force acting on drive elements (23) of the drum (18) in the context of providing a rotational force, the slider (31) in the firing position of the firearm engaging adjustingly into adjusting recesses (39) on the circumference of the drum (18) and which are arranged between the drum bores (19), and in the loading position, the trigger (4) is automatically latched against actuation.

2. Compressed gas-operated firearm according to claim 1, characterized in that a first arm (48) of a double-armed lever (45) which is pivotable about an axis stands under a spring force radially against the axle (22) of the drum (18), whereas the second arm (49) in the loading position engages into the path of movement of the lever system (4, 31, 35, 41) which is connected with the trigger (4).

3. Compressed gas-operated firearm according to claim 1 or 2, characterized in that there is provided a breech block lever (7) which is arranged on the breech block (2) so as to be pivotable about an axis (8) and which unlatches the barrel (3) under a spring force in the firing position.

4. Compressed gas-operated firearm according to claim 1, characterized in that the drum bore (19) in the firing position of the drum 18, is sealingly contacted by a coaxially arranged hollow-cylindrical valve stem 55 which is movable opposite force of a valve spring (60) into a valve member (52) from an idle position into the firing position, whereby the valve body (52) is connectable with an arrangement (15) for the delivery of compressed gas or compressed air.

5. Compressed gas-operated firearm according to claim 4, characterized in that a firing pin (11) which is actuated by the hammer (12) of the firearm (1) acts impulse-like opposite the force of the valve spring (60) on the valve stem (55).

6. Compressed gas-operated firearm according to claim 4 or 5, characterized in that the valve stem (55) in the idle or, respectively, loading position, due to spring force contacts an end seal arrangement (58) of the valve body (52), which closes a chamber (62) which is filled with gas or air.

* * * * *